US007459652B2

(12) United States Patent
Rival

(10) Patent No.: US 7,459,652 B2
(45) Date of Patent: Dec. 2, 2008

(54) SWITCHGEAR DEVICE COMPRISING AN ARC CHUTE OF REDUCED SIZE

(75) Inventor: Marc Rival, St. Ismier (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 141 days.

(21) Appl. No.: 11/512,152

(22) Filed: Aug. 30, 2006

(65) Prior Publication Data

US 2007/0062912 A1 Mar. 22, 2007

(30) Foreign Application Priority Data

Sep. 16, 2005 (FR) ..... 05 09487

(51) Int. Cl.
*H01H 33/02* (2006.01)

(52) U.S. Cl. ..... 218/149; 218/34; 218/157

(58) Field of Classification Search ..... 218/34, 218/35, 38, 147–149, 151, 156, 157; 335/201, 335/202

See application file for complete search history.

(56) References Cited

U.S. PATENT DOCUMENTS

| | | | | |
|---|---|---|---|---|
| 1,963,643 | A | 6/1934 | Brainard et al. | 200/144 |
| 2,468,422 | A | 4/1949 | Wood | 200/144 |
| 4,885,441 | A | 12/1989 | Hisatsune et al. | 100/144 R |
| 6,204,465 | B1 * | 3/2001 | Gula et al. | 218/154 |
| 6,288,621 | B1 * | 9/2001 | Rival | 218/148 |
| 6,297,465 | B1 * | 10/2001 | Groves et al. | 218/156 |
| 6,373,016 | B2 * | 4/2002 | Brouillat et al. | 218/154 |
| 7,034,242 | B1 * | 4/2006 | Shea et al. | 218/157 |

FOREIGN PATENT DOCUMENTS

| | | |
|---|---|---|
| DE | 10 2004 002932 | 8/2005 |
| FR | 2 803 687 | 7/2001 |

* cited by examiner

*Primary Examiner*—Elvin G Enad
*Assistant Examiner*—Marina Fishman
(74) *Attorney, Agent, or Firm*—Steptoe & Johnson LLP

(57) ABSTRACT

Electric switchgear device comprising at least one electric pole-unit comprising a stationary contact part made of conducting material, a movable contact part and an arc chute. The arc chute comprises two side parallel flanges, a rear wall, and a bottom arcing horn made of conducting material, electrically connected to the stationary contact part. Said bottom arcing horn is surrounded by a periphery made of gas-generating material. The arc chute comprises a stack of separators at least two of which separators comprise a notch. The arc chute comprises at least one regenerating separator placed parallel to the bottom arcing horn, said at least one separator comprising at least one metallic surface covering at least half of the notches in the longitudinal mid-plane.

12 Claims, 3 Drawing Sheets

SWITCHGEAR DEVICE COMPRISING AN ARC CHUTE OF REDUCED SIZE

BACKGROUND OF THE INVENTION

The invention relates to an electric switchgear device comprising at least one electric pole-unit comprising a stationary contact part made of conducting material, a movable contact part able to move from a closed position wherein it is in contact with the stationary contact part to an open position wherein the two contact parts are separated. The electric switchgear device comprises an arc chute comprising two parallel side flanges placed on each side of a longitudinal mid-plane, a rear wall, a bottom arcing horn made of conducting material connected to the stationary contact part and extending close to the rear wall. Said bottom arcing horn is surrounded by a periphery made of gas-generating material. The arc chute comprises a stack of separators extending from one side flange to the other, substantially perpendicularly to the longitudinal mid-plane, at least two of the separators comprising a notch extending in the longitudinal mid-plane.

STATE OF THE ART

When a high-intensity low-voltage switchgear device is used to break electric currents of low intensity in relatively high voltages, of about 600 Volts rms in single-phase, or 1000 Volts rms in three-phase, the arc chutes have to withstand strong thermal and mechanical stresses. Said electric currents of low intensity are about 5 to 15 times the rated current.

The dimensions of the arc chutes have to respect certain design rules to provide an energy exchange volume necessary for extinguishing the arc.

The depth of the arc chute, i.e. its longitudinal dimension between the entrance of the arc chute and the gas extraction wall, has to be sufficient to accommodate the energy exchange volume necessary for extinguishing the arc. However, it often proves desirable to reduce the size of these arc chutes to be able to propose switchgear devices of reduced size.

The document FR2604026 describes a switchgear device the bottom arcing horn whereof broadens from its front part close to the contacts to its rear part close to the back of the arc chute. The broadened rear part constitutes a collecting part the surface whereof is smaller than the cross-section of an arc root that would be formed with a constant electric current density corresponding to the rated breaking current. The objective here is to move the arc onto the collecting part and to stabilize it there. The stabilized arc then develops essentially in the middle part of the arc chute. Such a configuration is only efficient if the longitudinal dimension of the arc chute i.e. the depth thereof between the stationary contact zone and the rear wall of the arc chute serving the purpose of extracting the gases, is large. The width of the arc chute can be reduced, as it is not used for extinguishing the arc.

The solution described in Patent FR2803687 comprises a device the bottom arcing horn whereof is solicited to the same degree on the two most lateral parts of the rear end zone. This enables it to be asserted that the two lateral parts of the arc chute have contributed in very close proportions to absorbing the energy given off by the arc, and therefore to extinguishing the arc. This is due to the particular shape of the arcing horn which fosters high-speed lateral oscillation of the arc from one side of the rear end zone of the arcing horn to the other. This arrangement enables the available width of the arc chute to be used to the full, thus enabling breaking of a high-voltage arc, of more than 600 volts rms for the phase considered, to be obtained, with an arc chute of small depth. This type of solution finds a particularly useful application in terms of reduction of volume as far as the depth of the arc chute is concerned. The invention preferentially applies to a relatively wide pole-unit, in particular a pole-unit wherein the distance between the contact zone of the stationary contact part and the rear wall of the arc chute is smaller than the distance between the side flanges of the arc chute. It also applies to a pole-unit the bottom arcing horn whereof has a length, measured in the longitudinal mid-plane, that is smaller than the largest width of the rear part of the arcing horn measured along an axis perpendicular to the longitudinal mid-plane.

However the solution of the Patent FR2803687 can not be adapted to switchgear devices the arc chute whereof also has to be reduced in width while keeping the same proportions in the other directions.

SUMMARY OF THE INVENTION

The object of the invention is therefore to remedy the shortcomings of the state of the art so as to propose an arc chute of reduced size enabling the arc to be extinguished at the moment breaking of low-intensity currents is performed under high voltages.

The arc chute of the switchgear device according to the invention comprises at least one regenerating separator placed in parallel manner to the bottom arcing horn, said at least one regenerating separator comprising at least one metallic surface covering at least a half of the notches in the longitudinal mid-plane.

Preferably, the metallic surface of said at least one regenerating separator is at least equal to one quarter of the surface of the arc chute in the plane XY, said metallic surface being substantially centered with respect to the bottom of the notches of the separators.

Preferably, the width and length of the regenerating separator are respectively at least equal to 50% of the width and length of said separators.

According to a preferred embodiment of the invention, the regenerating separator comprises a notch extending along the longitudinal mid-plane, the length of said notch being smaller than the length of the notches of the other separators.

Advantageously, the length of the notch is smaller than or equal to 60% of the length of the notches.

Advantageously, the length of the notch is comprised between 20 and 50% of the length of the notches.

Preferably, said at least one separator has a larger thickness than that of the other separators.

Preferably, said at least one regenerating separator is placed between the bottom arcing horn and the first separator.

Preferably, the electric switchgear device comprises a single regenerating separator.

According to another preferred embodiment of the invention, the electric switchgear device comprises a top arcing horn made of conducting material substantially parallel to the separators.

Preferably, the top arcing horn forms an angle with the set of separators.

In a particular embodiment, the top arcing horn comprises a flap extending parallel to the rear wall in the direction of the bottom arcing horn, the movable contact part being designed to be facing said flap in the open position.

Advantageously, the bottom arcing horn is surrounded by a periphery salient with respect to the rear part of said bottom arcing horn.

BRIEF DESCRIPTION OF THE DRAWINGS

Other advantages and features will become more clearly apparent from the following description of a particular embodiment of the invention, given as a non-restrictive example only and represented in the appended drawings.

DETAILED DESCRIPTION OF AN EMBODIMENT

Figure 1:
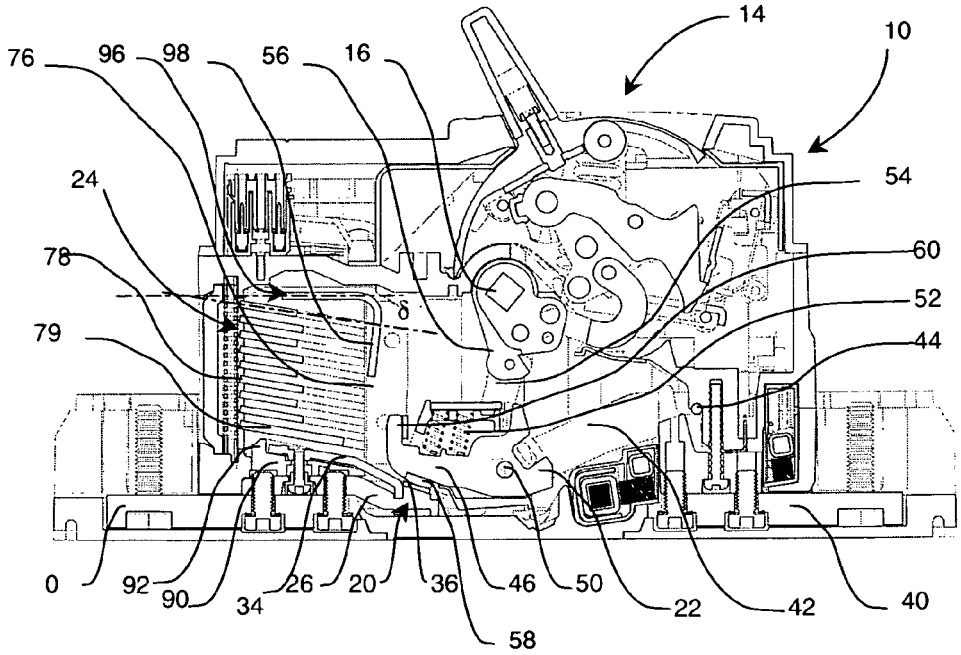
FIG. 1 represents a view of a pole-unit of a switchgear device according to a first embodiment of the invention, in cross-section along a longitudinal mid-plane of an arc chute of this pole-unit.
Figure 2:
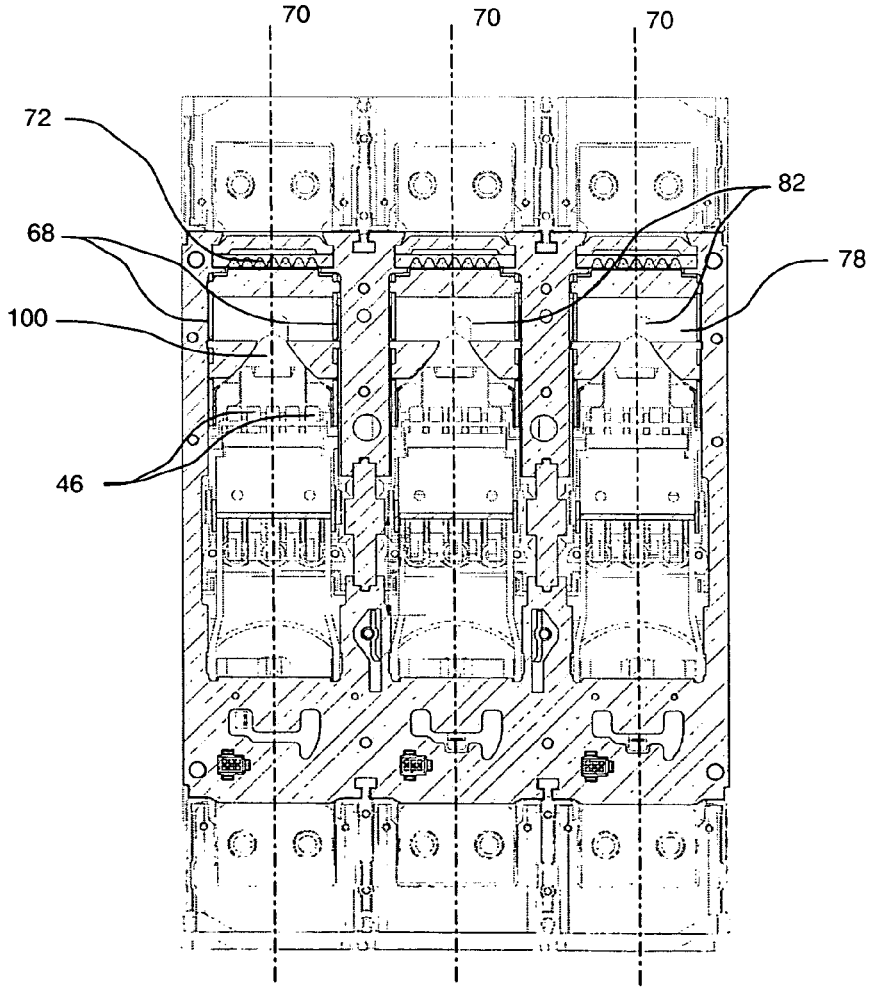
FIG. 2 represents a top view of the pole-unit of FIG. 1.
Figure 3:
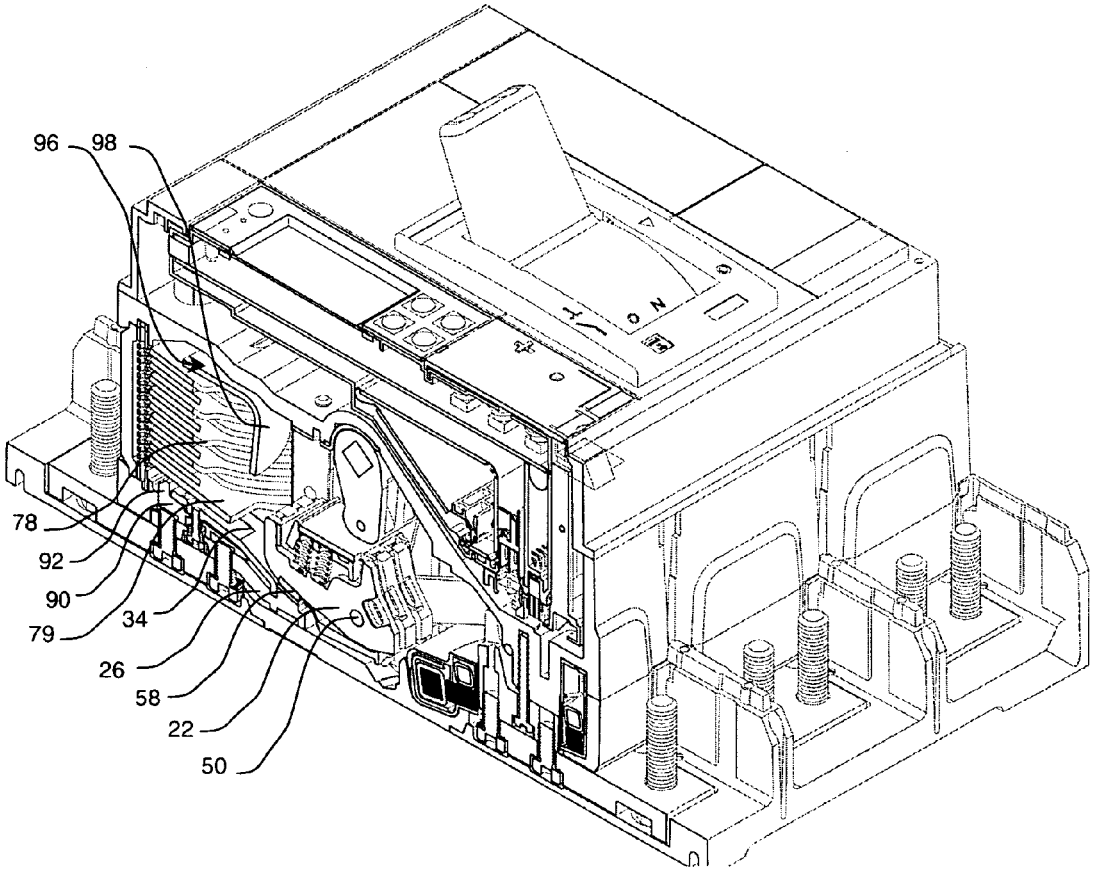
FIG. 3 represents an exploded perspective view of a part of the pole-unit of FIG. 1, showing in particular the arc chute.

According to the preferred embodiment of the invention, with reference to FIGS. 1 to 3, a multipole low-voltage power switchgear device 10 comprises a moulded insulating case 12 housing an operating mechanism 14 of known type equipped with a transverse switching bar 16 common to all the pole-units, swivel-mounted in bearings arranged in the case 12. Each pole-unit comprises a stationary contact part 20, a movable contact part 22 and an arc chute 24 located close to the stationary contact part 20.

The stationary contact part 20 comprises a current input terminal 26 fitted in the bottom of the case 12, partially under the arc chute 24. The stationary current input terminal 26 comprises a contact strip 36 that operates in conjunction with contact pads 58 of the contact fingers 46 of the movable contact part 22. The contact fingers 46 are electrically connected to the current input terminal 40 by means of a tunnel 42.

The stationary current input terminal 26 is extended towards the inside of the arc chute 24 by a conducting bottom arcing horn 34. The current input terminal 26 and the arcing horn 34 are made from various conducting metal materials and are at the same potential.

The bottom arcing horn 34 is designed to receive the arc root when the arc extends from the stationary contact strip 36 towards the inside of the arc chute 24. The bottom arcing horn 34 formed by a conducting metal plate is fixed via an external face to the terminal 26 of the stationary contact part 20. It comprises an internal face situated inside the arc chute 24. The rear part of the arcing horn 34 extends close to the rear wall 72 of the arc chute 24.

The bottom arcing horn 34 is fixed onto a base part formed by a plate made of insulating material 90, in this instance polyamide 6-6 30% charged with glass fibre. Said plate comprises an imprint corresponding to the shape of the bottom arcing horn in which imprint the arcing horn 34 is housed.

The part of the plate 90 not covered by the arcing horn extends up to the flanges 68 and the rear wall 72. It presents a periphery 92 forming a rim salient into the arc chute 24 and flush with the periphery of the internal face of the arcing horn 34. Alternatively, the periphery 92 can be salient towards the inside of the arc chute up to a larger height than that of the internal face of the arcing horn.

The periphery 92 has a rounded C-shape that hugs the edge of the rear part of the arcing horn so as to form a separation between the rear part of the horn and the rear wall 72 of the arc chute on the one hand, and between the rear part and the side flanges 68 on the other hand.

The movable contact part 22 for its part comprises a conducting stationary current input terminal 40, a support tunnel 42 mounted swivelling around an axis 44 fixed with respect to the case 12. The movable contact part 22 can preferably comprise a plurality of contact fingers 46. The contact fingers 46 pivot around a common geometric axis 50 that is fixed with respect to the tunnel 42, and are biased towards the stationary contact part 20 by contact pressure springs 52. A connecting rod 54 acts as coupling between the tunnel 42 of the movable contact part 22 and a crank 56 of the switching bar 16 of the mechanism 14. Each finger 46 comprises a contact pad 58 designed to ensure contact with the contact strip 36 of the stationary contact part 20 when the switchgear device is in the closed position.

In addition, the movable contact part 22 preferably comprises a spigot 60 salient beyond the contact pad towards the arc chute 24. The contact fingers 46 are electrically connected to the current input terminal 40 by means of braids.

The arc chute 24 comprises two side flanges 68 made of insulating material which are parallel to the cross-sectional plane of FIG. 1. Said flanges are situated at equal distance on each side of the cross-sectional plane so that this plane constitutes a longitudinal geometric mid-plane 70 of the arc chute 24 and of the pole-unit. A rear wall 72 for outlet of the gases is arranged at the rear of the arc chute 24, perpendicularly to the side flanges 68. This wall 72 comprises one or more outlet orifices for the breaking gases. A front opening 76 is arranged near to the contact strip 36, opposite the rear wall 72. Separators 78 formed by flat metal plates extend perpendicularly to the longitudinal mid-plane 70 from the front opening 76 to the rear wall 72. The separators 78 are arranged at a distance from one another so as to enable gas flow between the front opening 76 and the rear wall 72. They are supported laterally by the side flanges 68.

Each separator 78 has a front edge defining a notch 80 for capturing the electric arc in the plane of the plate. This notch 80 approximately presents a curved concave U- or V-shape. This notch 80 extends in the longitudinal mid-plane 70.

The arc chute 24 comprises at least one regenerating separator 79 positioned parallel to and very close to the bottom arcing horn 34. Said regenerating separator 79 is positioned substantially parallel to the separators 78. In the embodiment, said at least one regenerating separator 79 is placed between the bottom arcing horn 34 and the first of the separators 78. The distance separating the regenerating separator 79 from said horn is substantially equal to the thickness of the separators 78. Said at least one regenerating separator 79 is generally made from a metallic material similar to that of the other separators 78. Furthermore, said at least one separator 79 preferably has a larger thickness than that of the other separators 78.

According to the different embodiments described below, a single regenerating separator 79 is placed next to the bottom arcing horn 34

According to the preferred embodiment of the invention, the separator comprises at least one metallic surface that is at least equal to one quarter of the surface of the arc chute in the plane XY. Moreover, said metallic surface is arranged with respect to the other separators 78 in such a way as to cover at least half of the notches 80 in the longitudinal mid-plane 70.

Figure 4:
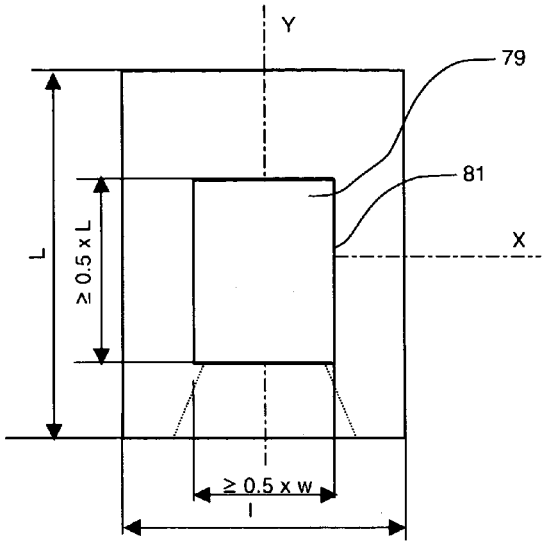
FIG. 4 represents a top view of a regenerating separator according to a first preferred embodiment of the invention.
Figure 5:
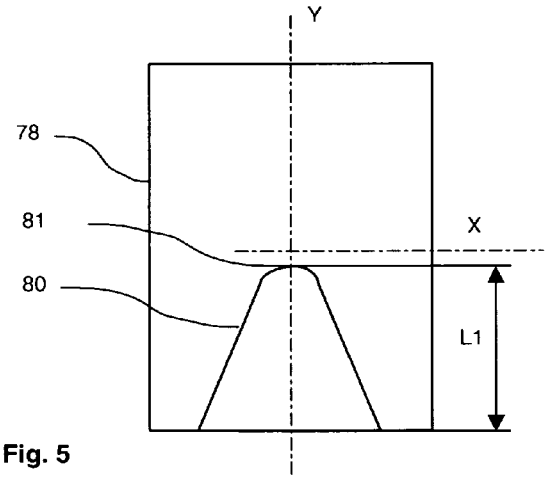
FIG. 5 represents a top view of a separator of the arc chute according to FIG. 1.

As represented in FIG. 4, said metallic surface is substantially centered with respect to the bottom 81 of the notches 8 of the separators 78.

The width and length of the regenerating separator 79 are respectively at least equal to 50% of the width I and length L of the separators 78.

The regenerating separator is placed and secured in a frame, not represented, two sides of which frame are fixed to the side flanges 68. The frame can be made for example from a ceramic material.

Figure 6:
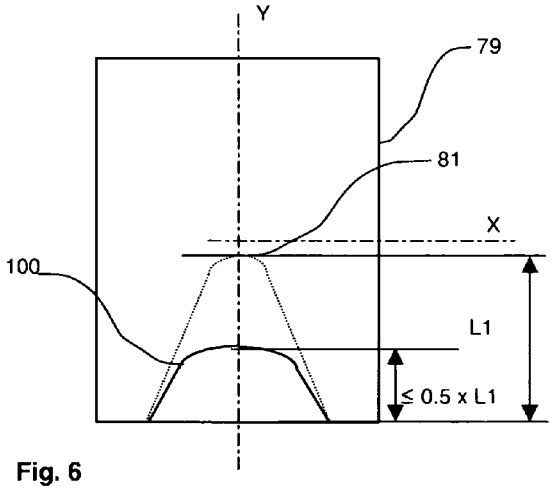
FIG. 6 represents a top view of a regenerating separator according to a second preferred embodiment of the invention.

According to a second preferred embodiment of the invention, as shown in FIG. 6, the regenerating separator 79 comprises a front edge defining a notch 100 in the plane of the separator. Said notch extends along an axis y parallel to the longitudinal mid-plane 70. The notch 100 is less deep than that of the other separators 78. The length of said notch along the axis y is in fact smaller than the length L1 of the notches 80 of the other separators 78. For example, the length of the notch 100 of said at least one regenerating separator 79 is smaller than or equal to 50% of the length L1 of the notches 80. The length of the notch 100 is preferably comprised between 20 and 50% of the length L1 of the notches 80 of the other separators.

Operation of the device according to this preferred embodiment is as follows. In the closed position, the switching bar 16 latched by the mechanism 14, keeps the tunnel 42 in the position illustrated in FIG. 1. The springs 52 ensure a contact pressure between the movable contact finger 22 and the stationary arcing contact 20.

When a weak fault current is detected, an electronic trip device acts on the mechanism 14 that commands opening of the contacts. Rotation of the switching shaft 16 makes the tunnel 42 pivot around its axis of rotation 44. The contact fingers 22 pivot very slightly counterclockwise around the axis of rotation 50 due to the effect of the contact pressure springs 52, while remaining in contact with the strip 26. Then they encounter a stop of the tunnel 42 and are driven fixedly with the tunnel 42 in clockwise rotation around the axis of rotation 44 so that they separate from the strip 26.

An arc arises between the stationary and movable contacts 20, 22. Due to the electrodynamic current loop effect in the stationary contact part 20, the arc root immediately migrates to the edge of the front part of the bottom arcing horn 34 and then towards the inside of the arc chute 24. The arc, when entering the arc chute 24, divides more or less in contact with the separators 78, 79 into elementary arcs, each elementary arc constituting an electric connection in series between two adjacent separators 78 or between the bottom arcing horn 34 and the regenerating separator 79 facing the latter.

On reaching the rear part of the arc chute 24, the arc root tends to cause ablation of the periphery 92 made of gas-generating material with a large emission of gas, in particular hydrogen.

This gas emission in immediate proximity to the arc root causes a constriction of the arc root and results in cooling of the arc foot. A greater dielectric regeneration is thus observed locally which enables a weakly ionized zone to be obtained near the bottom part of the arc chute 24.

Moreover, the presence of a metallic regenerating separator 79 of sufficient mass and surface enables cooling of the arc foot to be significantly speeded up. On account of the fact that the arc foot is both circumscribed and localized mainly at the level of the centre of the regenerating separator 79, the electric arc does not flash on the edge of said separator facing the opening zone. The presence of this cooler zone on the front edge of the regenerating separator 79 limits the risk of a subsequent arc breakdown in this zone.

Local cooling of the electric arc must preferably be performed as close as possible to the bottom and/or top edges of the arc chute 24.

It should be emphasized that this phenomenon is only significant for breaking low-intensity currents in a high voltage. When breaking high-intensity currents in a low voltage, the arc invades the whole of the arc chute in conventional manner.

According to an alternative embodiment of the invention, the arc chute 24 comprises a top arcing horn 96. This arcing horn facilitates insertion of the arc in the arc chute and forces the arc to move in the separators 78 over the whole height of the arc chute. In addition, the top arcing horn 96 is designed to receive the head of the electric arc at the end of opening of the movable contact part 22. It is formed by a metal plate. This metal plate can be substantially parallel to the separators 78 or form an angle δ with the latter. According to the example described, the top arcing horn 96 forms an angle δ with the set of separators 78. Positioning of the top arcing horn is performed such that the movable contact comes close to said plate in the open position.

When the arc chute is of reduced size, the height of the stack of separators 78 can be greater than the movement travel of the movable contact 22. The top arcing horn 96 then has to be extended in a direction parallel to the rear wall 72. A flap 98 then extends parallel to the rear wall 72 in the direction of the bottom arcing horn 34. The presence of this flap 98 tends to reduce the surface of the front opening 76 such that the movable contact 22 in the open position is facing said flap 98. Thus, when the mechanism reaches the open position, the arc head switches on the top arcing horn 96, and a secondary arc forms in series with the first arc, between the flap 98 and the movable contact fingers 22.

According to a variant of the different embodiments, the curved shape of the notch 80 of the separators 78 comprises a notch 82 that is narrower and dissymmetric. The separators 78 are then stacked in such a way that the notches 82 are alternately on one and the other lateral side of the arc chute 24.

The invention claimed is:

1. An electric switchgear device comprising at least one electric pole-unit comprising:

a stationary contact comprising conducting material, a movable contact part movable from a closed position wherein it is in contact with the stationary contact part to an open position wherein the two contact parts are separated, an arc chute comprising:

two parallel side flanges, one on each side of and parallel to a longitudinal mid-plane, a rear wall, a bottom arcing horn comprising conducting material electrically connected to the stationary contact part and extending close to the rear wall, said bottom arcing horn surrounded at a periphery by gas-generating material, a stack of separators extending from one side flange to the other, substantially perpendicularly to the longitudinal mid-plane, each separator comprising a rear surface closest to the rear wall and a front surface at an opposite end of the separator from the rear surface, each of at least two of the separators having a notch therein, such that a substantially central portion of a front surface of the notched separators is closer to the rear surface than a portion of the front surface of the separators closest to the side flanges, said stack comprising:

at least one regenerating separator between the bottom arcing horn and the stack of separators and substantially parallel to the stack of separators, said at least one regenerating separator comprising at least one metallic surface, wherein a distance in a direction substantially parallel to each separator, respectively, along a longitudinal mid-plane, between a front end of the notch and a rear end of the notch defines a notch depth, and the metallic plate of the regenerating separator extends from at least a point corresponding to the rear end of each of said notches along a longitudinal mid-plane, to at least to a point corresponding to half the depth of each of said notches along the longitudinal mid-plane.

2. The electric switchgear device according to claim 1, wherein a surface area of the metallic surface of said at least one regenerating separator is at least one quarter of the surface area of the arc chute in the plane XY, said metallic surface being substantially centered with respect to the bottom of the notches of the separators.

3. The electric switchgear device according to claim 2 wherein the width and length of the regenerating separator are respectively at least equal to 50% of the width and length of said separators.

4. The electric switchgear device according to claim 1, wherein the front surface of the regenerating separator comprises a notch, and a depth of said notch is smaller than the depth of the notches of each of the notched separators.

5. The electric switchgear device according to claim 4 wherein the depth of the notch of the regenerating separator is smaller than or equal to 50% of the depth of the notches of the notched separators.

6. The electric switchgear device according to claim 5 wherein the depth of the notch of the regenerating separator is between 20 and 50% of the depth of the notches of the notched separators.

7. The electric switchgear device according to claim 1 wherein said at least one separator has a larger thickness than that of the other separators.

8. The electric switchgear device according to claim 1 comprising a single regenerating separator.

9. The electric switchgear device according to claim 1, further comprising a top arcing horn comprising conducting material and substantially parallel to the separators.

10. The electric switchgear device according to claim 1, further comprising a top arcing horn comprising conducting material and substantially parallel to the separators, wherein the top arcing horn forms non-parallel angle with the set of separators.

11. The electric switchgear device according to claim 9 wherein the top arcing horn comprises a flap extending parallel to the rear wall in the direction of the bottom arcing horn, the movable contact part facing said flap in the open position.

12. The electric switchgear device according to claim 1, further comprising a plate made of insulating material, said plate having an indentation corresponding to the shape of the arcing horn for housing said arcing horn, wherein a portion of the plate along a periphery of a rear part the arcing horn extends upwards from the arcing horn.

* * * * *